United States Patent [19]

Pershin et al.

[11] 4,157,102

[45] Jun. 5, 1979

[54] DEVICE FOR MOVING DIES IN A MACHINE FOR THE MANUFACTURE OF TWISTED WIRE ARTICLES WITH ALTERNATING DIRECTION OF TWIST

[75] Inventors: Gennady D. Pershin; Valentin P. Emelyanov; Gennady K. Schegolev, all of Magnitogorsk Chelyabinskol oblasti, U.S.S.R.

[73] Assignee: Vsesojuzny Nauchno-Issledovatelsky Institut Metiznoi Promyshlennosti (Vniimetiz), Magnitorsk, U.S.S.R.

[21] Appl. No.: 869,126

[22] Filed: Jan. 13, 1978

[51] Int. Cl.[2] ..... B21F 7/00

[52] U.S. Cl. ..... 140/149; 226/163

[58] Field of Search ..... 140/115, 149, 51; 269/238; 226/162, 163

[56] References Cited

U.S. PATENT DOCUMENTS

| | | | |
|---|---|---|---|
| 2,594,503 | 4/1952 | Sanderson | 269/238 |
| 3,616,531 | 11/1971 | Tyler | 140/149 |

*Primary Examiner*—Lowell A. Larson

*Attorney, Agent, or Firm*—Fleit & Jacobson

[57] ABSTRACT

A device comprises a slider mounted fo reciprocations in guides extending along the axis of pulling an article. A mechanism for clamping dies comprises a double-arm level articulated to the slider and to a piston rod of an actuating cylinder having its piston chamber communicating with a passage for a slide valve having a drive means. A lower die is rigidly fixed to the slider and an upper block is secured to the free end of the lever.

5 Claims, 4 Drawing Figures

DEVICE FOR MOVING DIES IN A MACHINE FOR THE MANUFACTURE OF TWISTED WIRE ARTICLES WITH ALTERNATING DIRECTION OF TWIST

BACKGROUND OF THE INVENTION

The present invention relates to devices for moving dies in machines for the manufacture of twisted wire articles with alternating direction of twist, such as for making sawing ropes to be used for abrasive sawing of natural stone or for making electric cables.

At present, rotary machines are widely used for making twisted articles with alternating direction of twist. In such machines, a rotor made in the form of a basket or cigar is caused to rotate reversibly to twist an article. Heavy weight and large radius of the rotor do not permit operation at high speed when frequent changing of rotation direction since it results in heavy inertial and dynamic machine loads and requires high power consumption.

Therefore the manufacture of rope-type articles with alternating direction of twist on rotor-type machines is rather ineffective so that rotor-less machines are coming into wider use for the same purpose.

USSR Inventor's Certificate No. 501,127 discloses a device for moving dies in a rotor-less machine for making twisted wire articles with alternating direction of twist. The device is provided with guides fixed on the machine bed along the axis of pulling the article. A slider having a lower block rigidly fixed thereto is mounted in the guides for reciprocations. An upper die cooperates with the lower block by means of a wedge-type clamping mechanism.

However, the wedge-type clamping mechanism cannot ensure complete prevention of the article from rotating thus resulting in lower quality of twisted articles.

An increase in the wedging force to improve the bond between the dies and the article requires the use of a more powerful drive for moving the dies thus making the machine kinematics more sophisticated. Moreover, with an increase in the wedging force, the required unwedging force also increases to the same extent. It should be noted that load bearing capacity of twisted articles with alternating direction of twist under tension is limited due to untwisting of members of the article at the points of changing the direction of twist.

In view of an evergrowing demand for building and decorative materials made of natural stone, the demand for ropes with alternating direction of twisting used for abrasive cutting of stone also grows. However, known machines cannot cope with the growing demand for such articles so that improvement of these machines is now a long felt need.

It should be noted that the provision of rotor-less machines for the manufacture of electric cables would enable simplification of the production process and reduction of cost in making such articles.

SUMMARY OF THE INVENTION

The main object of the invention is to provide a device for moving dies in a machine for the manufacture of twisted wire articles with alternating direction of twist which enables an improvement of quality of twisting.

Another, not least important object of the invention is to provide for employment of a structurally simple device according to the invention in machines for the manufacture of twisted wire articles with alternating direction of twist.

It is an object of the invention to eliminate the above disadvantages.

These objects are accomplished by the provision of a device for moving dies in a machine for the manufacture of twisted wire articles with alternating direction of twist comprising guides fastened to the machine bed axially along the direction of pulling an article, a slider mounted for reciprocations in the guides and supporting a lower die rigidly fixed thereto, and an upper block mounted over the lower block to cooperate therewith by means of a clamping mechanism, wherein, according to the invention, the die clamping mechanism comprises an actuating cylinder and a double-arm lever which are articulated to the slider, one end of the lever supporting the upper die, and the other end of the level being articulated to a piston rod of the actuating cylinder having a piston chamber communicating with a passage for a slide valve having a drive means for its moving.

The use of the actuating cylinder and the lever in the device according to the invention enables application of a considerable force for clamping the article by means of the dies thereby reliably holding the article against rotation at the moments of changing the direction of twist, which is required to achieve a well defined alternation of the direction of twist in the finished article with the length of transition portions as short as possible. In addition, the parts of the device are structurally simple and reliable in operation so that the use of the device in a machine does not complicate its construction.

The means for moving the slide valve preferably comprises a cam and two stops mounted to the bed for cooperation with the control valve.

This construction of the drive means may be used in machines with mechanical control system.

The means for moving the slide valve may be made in the form of an electromagnet and a return spring cooperating periodically with the slide valve, as well as a limit switch mounted to the machine bed for actuation upon engagement by the slider which is connected to a weight by means of a flexible link.

The device having such a means may be advantageously used in machines having electric control system.

BRIEF DESCRIPTION OF THE DRAWINGS

The invention will now be described with reference to specific embodiments illustrated in the accompanying drawings, in which.

DETAILED DESCRIPTION OF THE INVENTION

Figure 1:
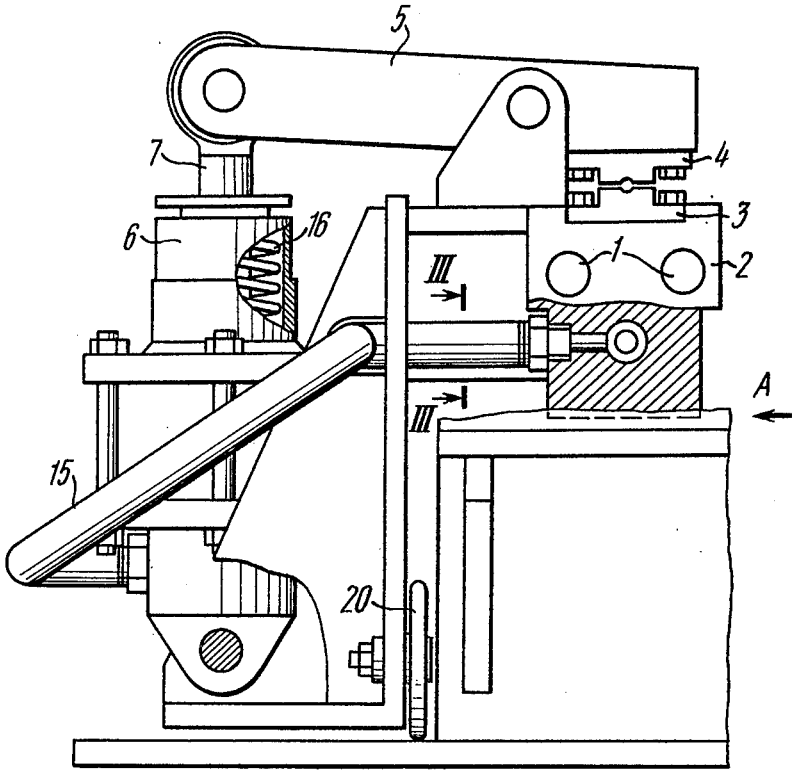
FIG. 1 is a cutaway view of the device according to the invention in the direction of movement of a rope.

The device according to the invention has guides 1 (FIGS. 1 and 2) for a reciprocatable slider 2 supporting a lower block 3 rigidly fixed thereto. An upper block 4 is arranged over the lower die 3 and carries a mechanism for clamping the dies 3 and 4 which comprises an actuating cylinder 6 (FIG. 1) and a double arm lever which are articulated to the slider 2 (FIG. 1). At one end of the double-arm lever an upper die is fixed.

A slide valve 8 (FIG. 2) is disposed in a longitudinal cylindrical passage of the slider 2 and has a groove 9, a shoulder 10 and a radial bore 11 communicating with an axial bore 12.

Figure 2:
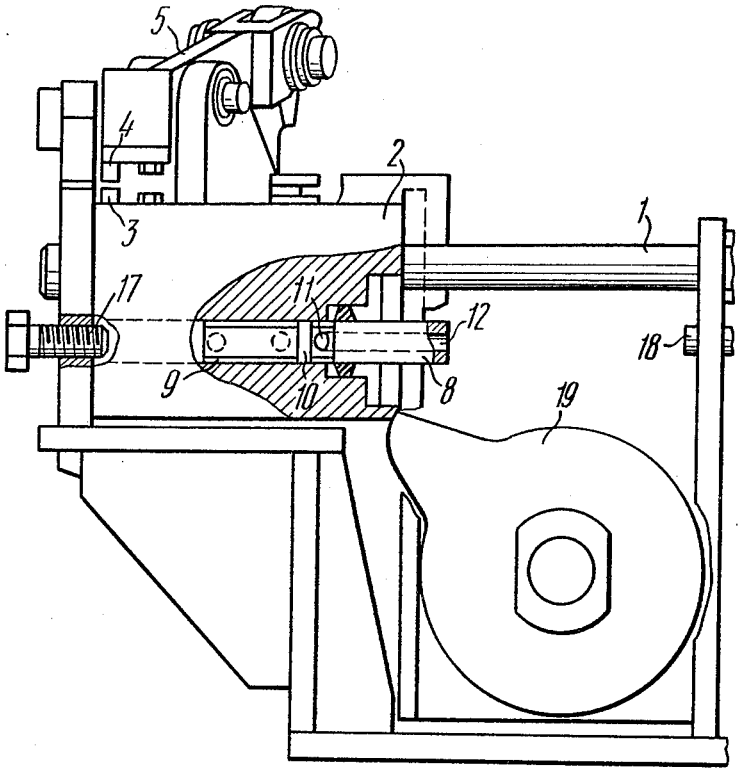
FIG. 2 is a lateral cutaway view of the same device along the arrow A in FIG. 1.
Figure 3:
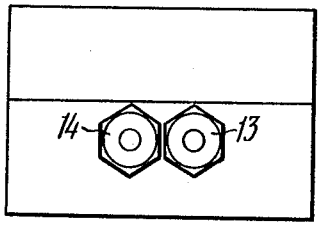
FIG. 3 is a sectional view taken along the line III—III in FIG. 1.

At the same level with the passage for the slide valve 9 and at right angle thereto, there are provided holes for a line connection 13 (FIG. 3) and a connection 14 with a hose 15 (FIG. 1) which establishes communication of the piston chamber of the actuating cylinder 6 with the passage for the control valve 8 (FIG. 2).

A return spring 16 is arranged in the piston rod chamber of the actuating cylinder 6. Adjustable stops 17 and 18 (movable in longitudinal direction) are mounted to the machine bed (not shown) in an axial alignment with the slide valve 8 (FIG. 2).

For moving the slider 2 in the guides 1, there is provided a cam 19 which is in a force transmitting connection with the machine drive (not shown).

In this embodiment, the means for moving the slide valve 8 comprises the cam 19 and two stops 17 and 18 cooperating alternately with the slide valve 8, which are mounted to the machine bed (not shown).

For taking up an overhanging load (weight of the device), there is provided a support roller 20 (FIG. 1).

The device functions in the following manner.

At the beginning of the twisting of a wire article, the die 3 and 4 of the device are spaced apart from each other, and a wire rope (not shown) being twisted in one of pre-set hands extends therebetween.

At the moment of changing the direction of twisting of the article (rope), the slider 2 is caused to move in the guides 1 under the action of the cam 19 towards the twisting dies of the machine (not shown). After cooperation with the stop 17 (FIG. 2), the slide valve 8 is moved to the right relative to the slider 2 until the annular groove 9 of the slide valve 8 establishes communication of the hole of the line connection 13 (FIG. 3) with the hole of the connector 14. Then air is admitted to the piston chamber of the actuating cylinder 6 (FIG. 1) and overcoming the resistance of the spring 16 causes the upward movement of the piston rod 7.

Upon the displacement of the piston rod 7 of the actuating cylinder 6, the end of the double-arm lever 5 connected thereto is also displaced, and the free end of the lever supporting the upper die 4 presses it to the lower die 3 to clamp the rope being twisted.

The cam 19 (FIG. 2) continues to rotate (FIG. 2) to cause the slider 2 to move into the left hand extreme position as shown in the drawing, and disengages from the slider. Then the slider 2 moves to the right, to the stop 18 under the action of the rope being clamped by the dies 3 and 4 and moved in the direction of pulling. Clamping of the rope by means of the blocks 3 and 4 occurs at the moment of reversing of a twisting head (not shown).

At the moment when the slide valve 8 cooperates with the stop 18, the slider 2 continues to move to the right relative to the slide valve 8, and the shoulder 10 of the slide valve 8 takes an intermediate position between the holes of the line connection 13 (FIG. 3) and the connector 14. These holes are thus disconnected, that is the air supply to the actuating cylinder 6 (FIG. 1) is cut-off. The air remaining in the actuating cylinder 6 leaves into atmosphere through the radial bore 11 (FIG. 2) and the axial bore 12 communicating therewith. Air pressure in the actuating cylinder 6 drops so that the return spring 16 (FIG. 1) can now move the piston rod 7 into the lowermost position.

The upper block 4 is caused to move upwards under the action of the lever 5 to release the article. The cam 19 continues to rotate (FIG. 2) to move the slider 2 in the guides 1 to the left towards the twisting dies (not shown), and the cycle is repeated, but the twisting is made in the opposite direction.

In another embodiment of the device according to the invention, the means for moving the slide valve 8 in machines with electrical control system may be constructed as follows.

Figure 4:
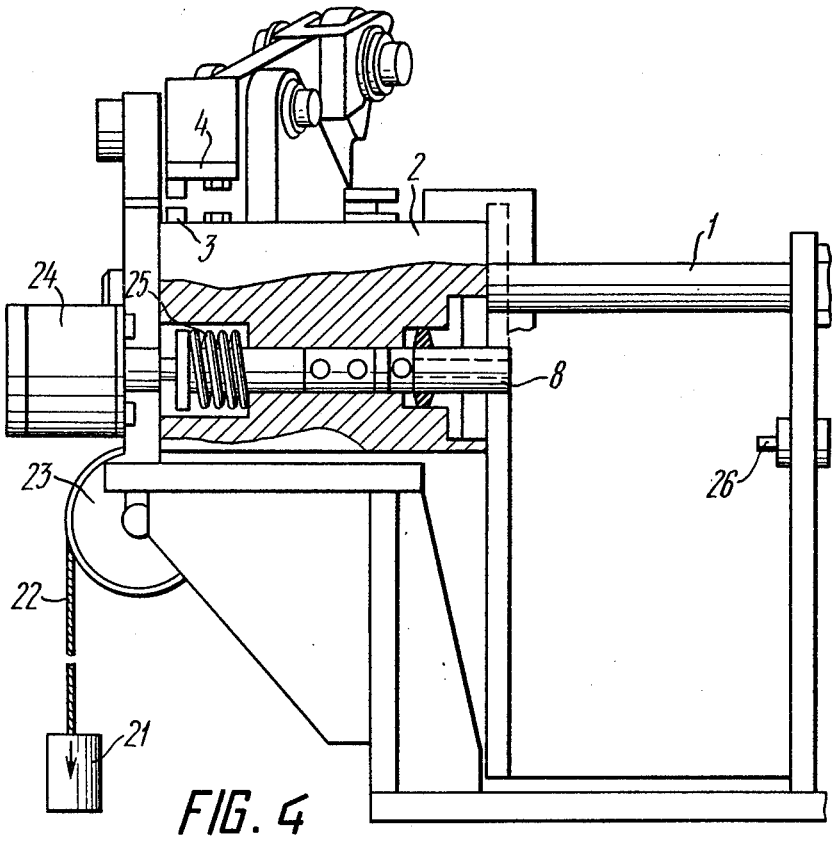
FIG. 4 shows the same device with an electromagnetic drive for slide valve moving.

To return the slider 2 (FIG. 4) into the initial position, a weight 21 may be used which is connected to the slider 2 by means of a flexible link 22 passed around a pulley 23, and the displacement of the slide valve 8 for air admission from an air line to the piston chamber of the actuating cylinder 6 (FIG. 1) is effected by means of an electromagnet 24 (FIG. 4) which is actuated at the moment of reversing of the twisting head (not shown).

Cutting-off the air supply into the piston chamber of the actuating cylinder 6 (FIG. 1) and the air yield from this chamber into atmosphere take place upon displacement of the slide valve 8 (FIG. 1) by a return spring 25 at the moment when the electromagnet 24 is deenergized as a result of cooperation of the slider 2 with a limit switch 26.

The movement of the slider 2 in the production process direction occurs, as described in the first embodiment, upon displacement of the article (rope) at the moment of its clamping by the dies of the device.

Operability and efficiency of the device according to the invention were confirmed by tests. The tests showed that the device was reliable in operation, improved quality of articles due to well defined changes in the direction of twisting of the article and enabled to obtain the length of transition portions which did not exceed the lay length.

We claim:

1. Device for moving dies to grip and release wire articles in a machine for the manufacture of twisted wire articles with alternating direction of twisting, said device comprising guides fastened to a bed of said machine along the axis of pulling; a slider having a through passage and mounted for reciprocal movement on said guides, said through passage being adapted to be connected to a source of fluid under pressure; means for moving the slider; a lower die fixed to said slider; an actuating cylinder articulated to said slider; a double-arm lever articulated to a piston rod of said actuating cylinder and to said slider and having a free end; an upper die secured to the free end of said lever; a control valve disposed in the slider through passage of said slider for controlling communication between the fluid source and the piston chamber of said actuating cylinder; and means for moving said control valve to control communication between the piston chamber and the fluid source.

2. Device according to claim 1, wherein said means for moving said slider comprises a cam, and wherein said means for moving said slide valve comprises two stops mounted to the machine bed, the control valve alternately cooperating with the stops.

3. Device according to claim 1, wherein said means for moving said control valve comprises an electromagnet and a return spring alternately cooperating with said control valve, and a limit switch for controlling said electromagnet mounted to the machine bed to be actuated upon movement of said slider.

4. Device according to claim 3 wherein said means for moving said slider includes a weight and a flexible link for connecting the weight to the slider.

5. Device according to claim 1 wherein the fluid under pressure is air.

* * * * *